US006854436B1

(12) United States Patent
English

(10) Patent No.: US 6,854,436 B1
(45) Date of Patent: Feb. 15, 2005

(54) COMPOSITE PUSH ROD

(75) Inventor: Eric H. English, Sand Springs, OK (US)

(73) Assignee: Performance Composites Inc, Tulsa, OK (US)

( * ) Notice: Subject to any disclaimer, the term of this patent is extended or adjusted under 35 U.S.C. 154(b) by 0 days.

(21) Appl. No.: 10/627,159

(22) Filed: Jul. 25, 2003

(51) Int. Cl.[7] ..... F01L 1/14

(52) U.S. Cl. ..... 123/90.61; 123/90.62; 123/90.64; 74/579 R; 74/586; 74/590; 74/594; 29/888.2; 464/183; 138/124; 138/137

(58) Field of Search ..... 123/90.61, 90.62, 123/90.64; 74/579 R, 586, 587, 590, 593, 594; 29/888.2; 464/183; 138/124, 137

(56) References Cited

U.S. PATENT DOCUMENTS

| | | | | | |
|---|---|---|---|---|---|
| 4,173,670 | A | * | 11/1979 | VanAuken | 138/123 |
| 4,186,696 | A | | 2/1980 | Linsenmann | 123/90.61 |
| 4,453,505 | A | | 6/1984 | Holtzberg et al. | 123/90.61 |
| 4,589,384 | A | * | 5/1986 | Ott | 123/90.61 |
| 4,848,286 | A | | 7/1989 | Bentz | 123/90.61 |
| 5,083,884 | A | | 1/1992 | Miller et al. | 403/404 |
| 5,154,146 | A | | 10/1992 | Hagerman et al. | 123/90.61 |
| 5,372,100 | A | | 12/1994 | Bertelson | 123/90.61 |
| RE35,282 | E | * | 6/1996 | Blane | 123/90.61 |
| 5,720,246 | A | | 2/1998 | Griffin et al. | 123/90.61 |
| 5,983,849 | A | | 11/1999 | Wangen et al. | 123/90.61 |
| 6,216,557 | B1 | | 4/2001 | Ishiuchi et al. | 74/579 R |

* cited by examiner

*Primary Examiner*—Thomas Denion
*Assistant Examiner*—Kyle M. Riddle
(74) *Attorney, Agent, or Firm*—Molly D. McKay

(57) ABSTRACT

An adjustable length composite push rod constructed of a composite bar having two specially shaped ends to which metal end fittings bond via mating surfaces provided thereon for evenly distributing mechanical stress from the metal end fittings to the composite bar. The bar is constructed of a plurality of layers of sheets of thermosetting, epoxy impregnated, longitudinally oriented fiber material that form the inner portion of the push bar and a single outside sheet of thermosetting, epoxy impregnated, woven fiber material forms the outside portion of the bar.

11 Claims, 5 Drawing Sheets

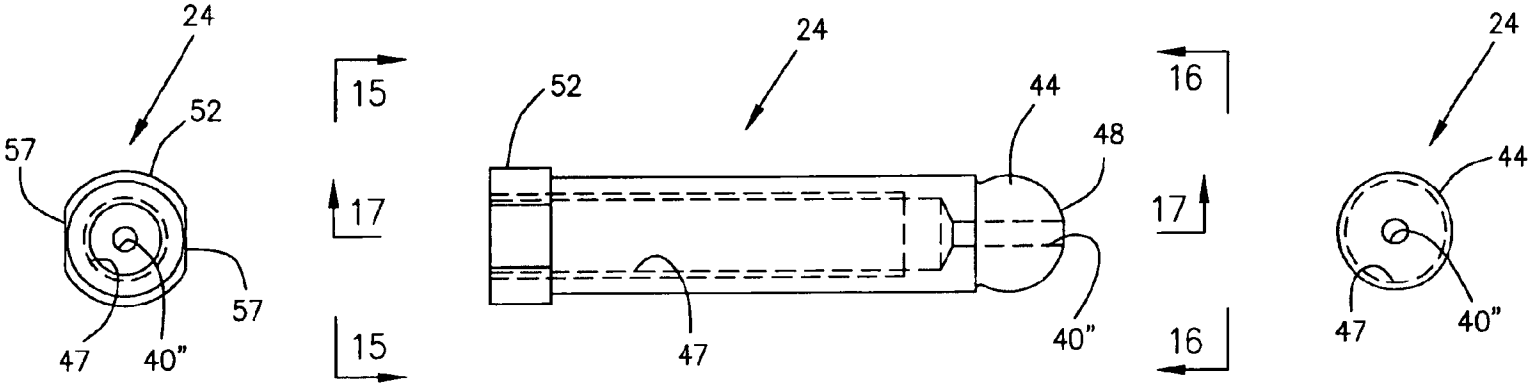
Fig. 16
Fig. 14
Fig. 15
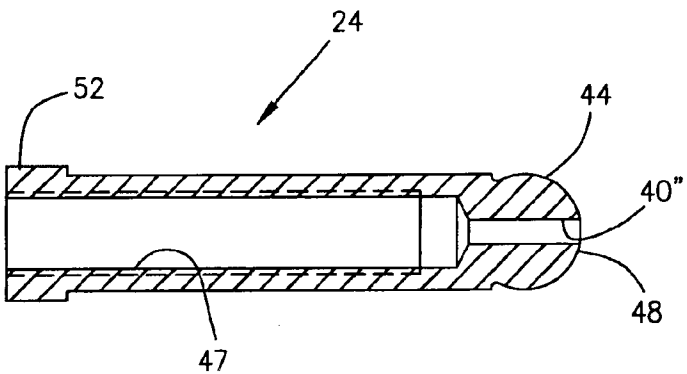
Fig. 17

COMPOSITE PUSH ROD

BACKGROUND OF THE INVENTION

1. Field of the Invention

The present invention relates to a composite push rod that is provided with two specially shaped ends to which metal end fittings bond via mating surfaces provided on the metal end fittings. The unique shape of the ends of the composite push bar and the mating surfaces on the metal end fittings evenly distribute stress that is exerted on the metal end fittings to the composite push bar. The push bar is constructed of a plurality of layers of sheets of epoxy impregnated, longitudinally oriented fiber material that form the inner portion of the push bar and a single outside sheet of epoxy impregnated, woven fiber material that forms the outside portion of the push bar. The layers of fiber material are thermo-set to form the composite bar. The ends of the composite bar are then cut to the proper shape and the metal end fittings are bonded to the ends of the composite bar via epoxy.

2. Description of the Related Art

Composite push rods are known as lighter weight replacements for metallic push rods in use between a cam shaft and a valve rocker in internal combustion engines for the purpose of reducing the weight of the push rod and thereby increasing the fuel economy and power of the engine or automobile in which the engine is used. These composite push rods are constructed of a bar that is made of composite material, such as carbon fiber. These composite push, bars generally have flat ends to which rounded metal end fittings are bonded, usually by some type of epoxy or adhesive. The composite push rod then attaches to the cam shaft and valve rocker via these rounded metal end fittings. A more complete description of one such composite push rod is contained in U.S. Pat. No. 4,186,696 which issued on Feb. 5, 1980 to Don R. Linsenmann.

One of the problems with these composite push rods is that the mechanical stress exerted on the push bars when they are under load conditions causes the composite bar to fray or broom where it attaches to the rounded metal end fittings, thereby weakening the bar at its ends and shortening the life of the composite push rod.

The present invention addresses this problem by employing a unique two-angled end on the composite bar to which mating surfaces are provided on each of the metal end fittings. This unique two-angled junction between the metal end fittings and the composite bar allows the stress to be transferred between the metal end fittings and the bar more evenly and efficiently, thereby preventing fraying of the bar at its ends. Also, the present invention is created from a stronger bar than taught in prior art patents because it employs more layers or sheets of longitudinally oriented fiber material in the construction on the bar's inner core.

SUMMARY OF THE INVENTION

The present invention is a composite push rod that is composed of a composite bar having two specially shaped ends to which metal end fittings bond via mating surfaces provided on one end of each of the metal end fittings. Each of the metal end fittings is provided with a rounded end opposite the end on which the mating surface for the composite bar is located. Also, one of the metal end fittings is adjustable in length. The unique shape of the ends of the composite bar and the mating surfaces on the metal end fittings facilitate even distribution of mechanical stress from the metal end fittings to the composite bar, thus preventing the composite bar from being damaged at its ends when placed under stress.

In order to construct the composite push rod, the bar is first constructed and then the ends are bonded. The bar is constructed of a plurality of layers of sheets of epoxy impregnated, longitudinally oriented fiber material that are wrapped around a removable mandrel. The sheets of longitudinally oriented fiber material form the inner portion of the push bar and a single outside sheet of epoxy impregnated, woven fiber material that is wrapped around the sheets of longitudinally oriented fiber material forms the outside portion of the bar. The sheets of fiber material are comprised on a fiber, such as carbon, Kevlar, or glass, and the fiber material is resin impregnated with a thermosetting, high temperature, toughened epoxy. Once all of the layers of fiber material are wrapped together, they are heated and compressed to thermo-set the layers into a single composite bar. The mandrel is then removed, leaving a central opening in the bar where the mandrel was located.

The ends of the composite bar are then cut to the proper shape and the mating surfaces of the metal end fittings are bonded to the ends of the composite bar via epoxy, thereby completing construction of the composite push rod.

BRIEF DESCRIPTION OF THE DRAWINGS

FIG. 14 is an enlarged side view of the female threaded half of the second metal end fitting of FIG. 2.

FIG. 15 is a proximal end view of the female threaded half of the second metal end fitting taken along line 15—15 of FIG. 14.

FIG. 16 is a distal end view of the female threaded half of the second metal end fitting taken along line 16—16 of FIG. 14.

FIG. 17 is a cross sectional view of the female threaded half of the second metal end fitting taken along line 17—17 of FIG. 14.

DETAILED DESCRIPTION OF THE PREFERRED EMBODIMENT THE INVENTION

Figure 1:
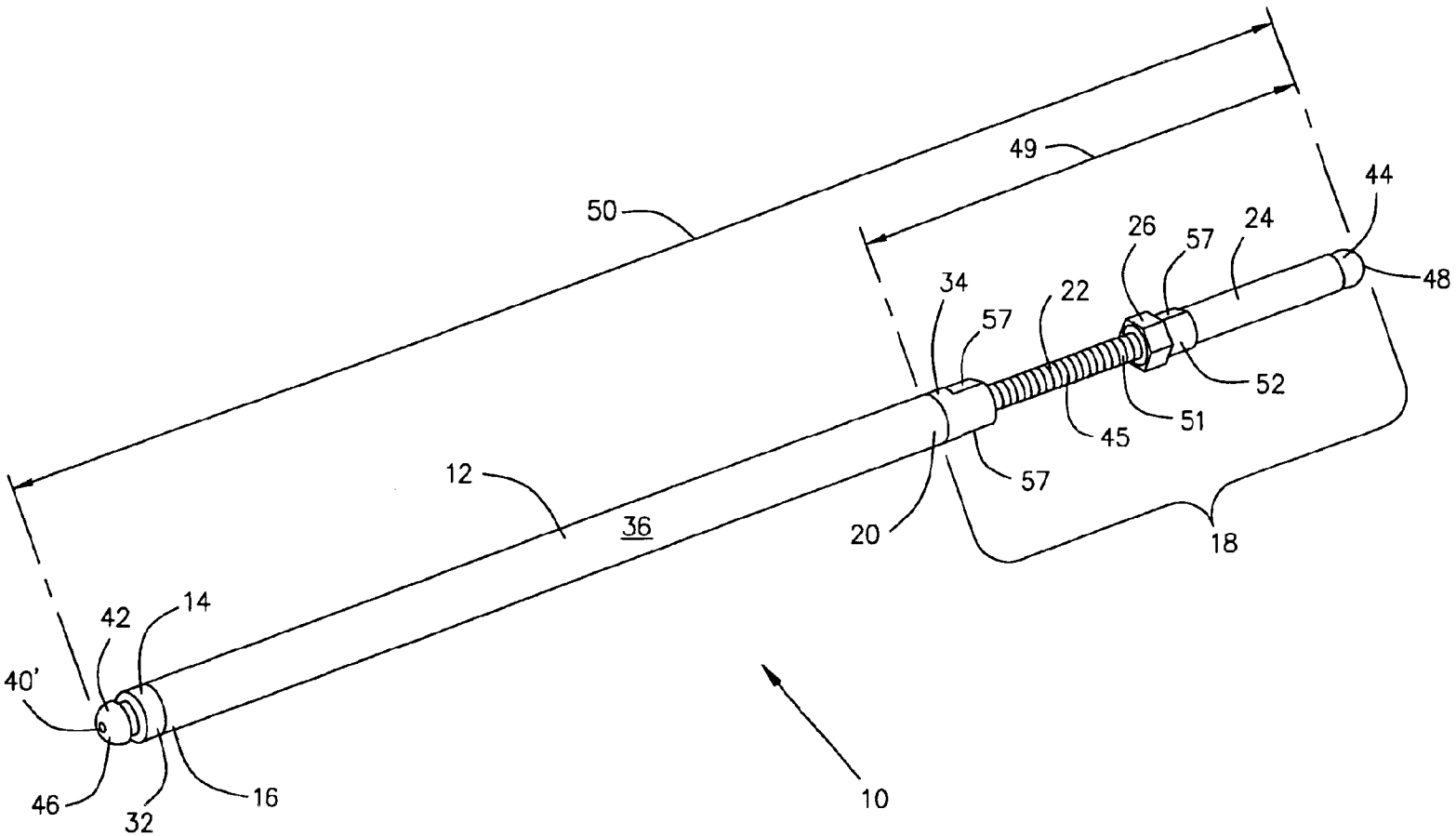
FIG. 1 is a perspective view of a composite push rod constructed in accordance with a preferred embodiment of the present invention.
Figure 2:
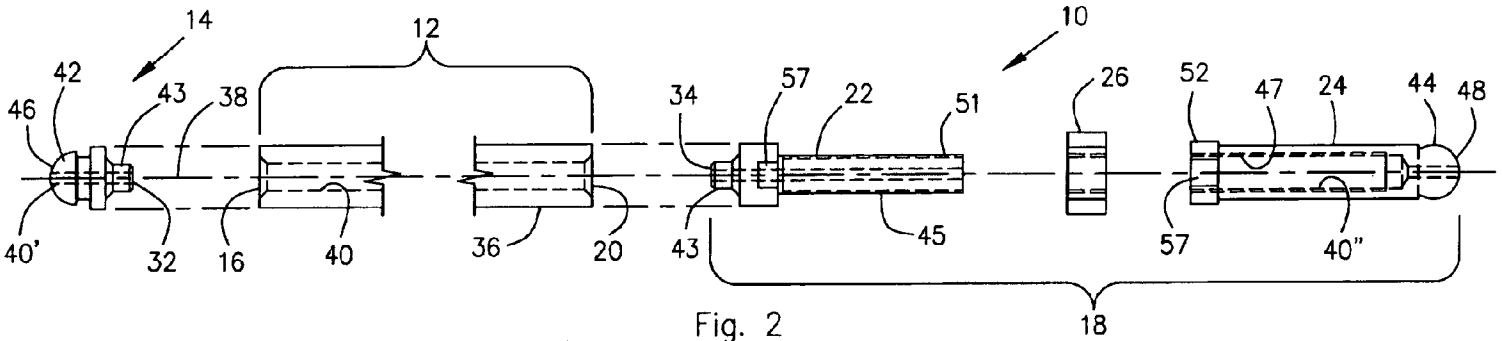
FIG. 2 is an exploded side view of the composite push rod of FIG. 1.

Referring now to the drawings and initially to FIGS. 1 and 2, there is illustrated a composite push rod 10 constructed in accordance with a preferred embodiment of the present invention. The push rod 10 is comprised of five parts a composite bar 12, a first metal end fitting 14 that bonds on a first end 16 of the composite bar 12, and an adjustable, three-piece, second metal end fitting 18 that bonds on an opposite second end 20 of the composite bar 12. The second metal end fitting 18 is comprised of a male threaded half 22, a female threaded half 24, and an internally threaded locking nut 26 that locks the male and female threaded halves 22 and 24 relative to each other when the composite push rod 10 has been adjusted to the desired length.

Figure 5:
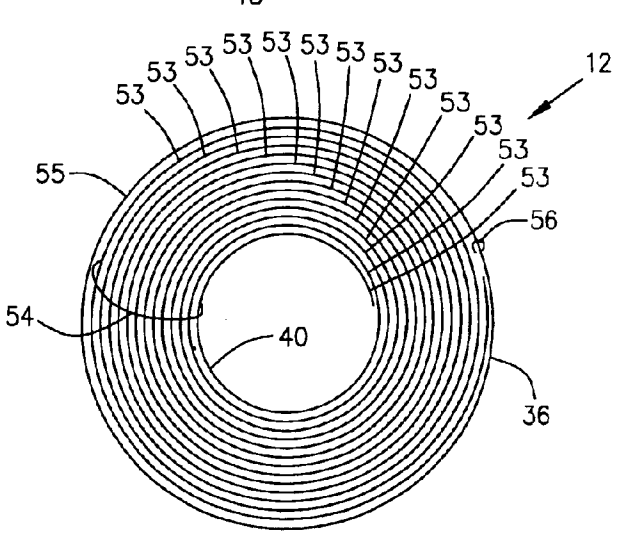
FIG. 5 is a greatly enlarged cross sectional view of the composite bar of FIG. 3 taken along line 5—5.
Figure 3:
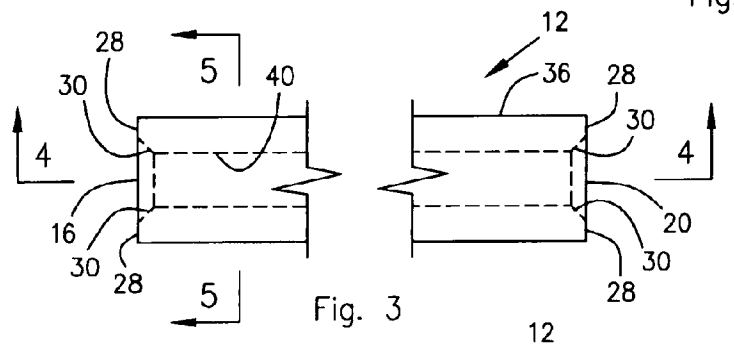
FIG. 3 is an enlarged side view of the composite bar of FIG. 2.
Figure 4:
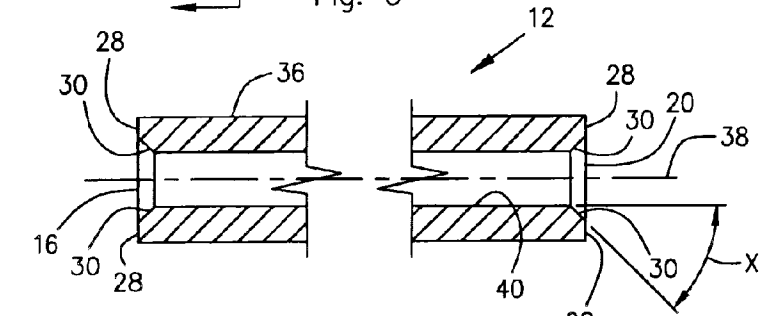
FIG. 4 is a cross sectional view of the composite bar of FIG. 3 taken along line 4—4.
Figure 8:
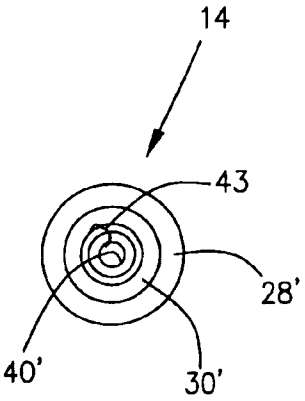
FIG. 8 is a proximal end view of the first metal end fitting taken along line 8—8 of FIG. 6.
Figure 6:
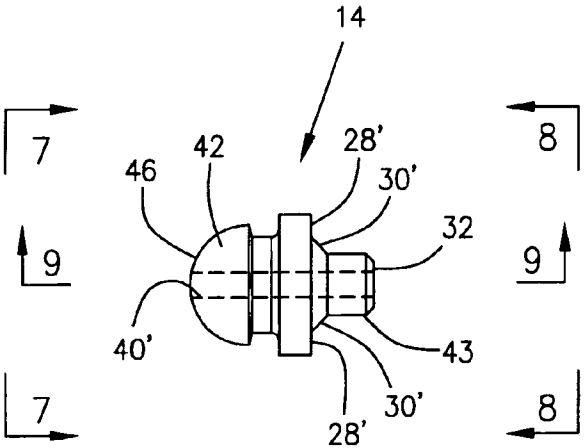
FIG. 6 is an enlarged side view of the first metal end fitting of FIG. 2.
Figure 9:
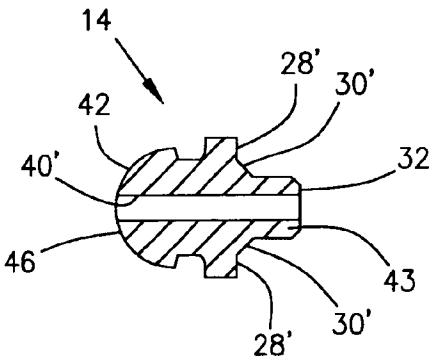
FIG. 9 is a cross sectional view of the first metal end fitting taken along line 9—9 of FIG. 6.
Figure 7:
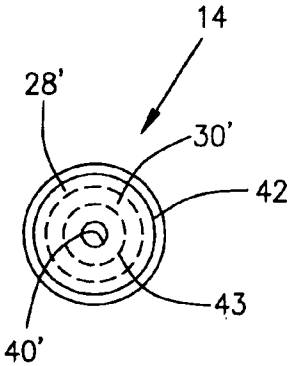
FIG. 7 is a distal end view of the first metal end fitting taken along line 7—7 of FIG. 6.
Figure 12:
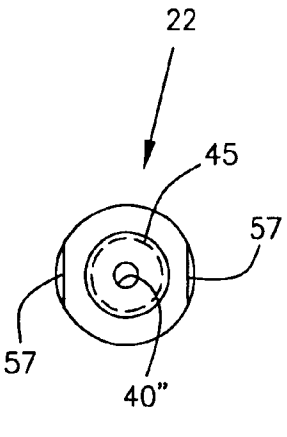
FIG. 12 is a distal end view of the male threaded half of the second metal end fitting taken along line 12—12 of FIG. 10.
Figure 10:
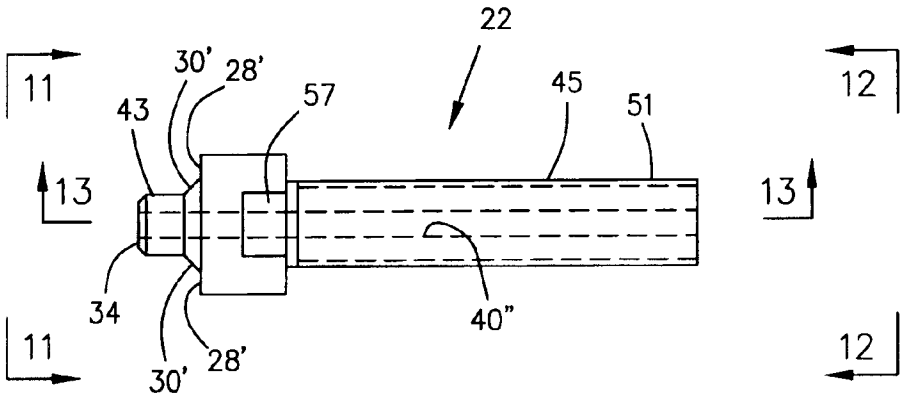
FIG. 10 is an enlarged side view of the male threaded half of the second metal end fitting of FIG. 2.
Figure 11:
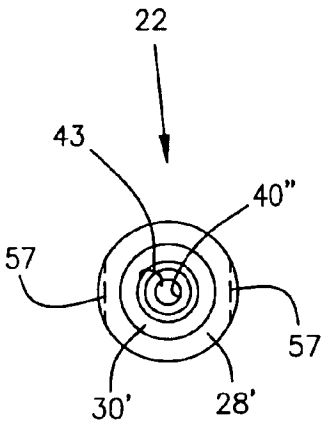
FIG. 11 is a proximal end view of the male threaded half of the second metal end fitting taken along line 11—11 of FIG. 10.
Figure 13:
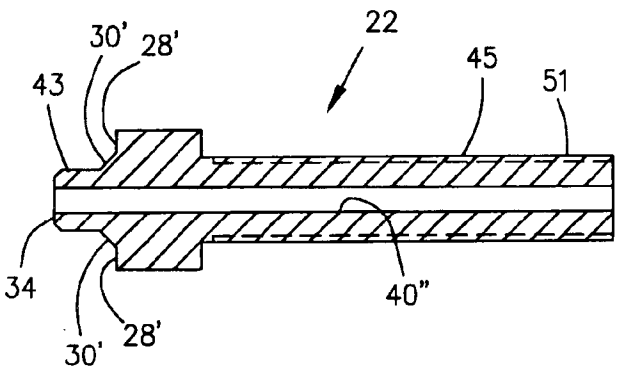
FIG. 13 is a cross sectional view of the male threaded half of the second metal end fitting taken along line 13—13 of FIG. 10.

Referring now to FIGS. 3–5, each of the ends 16 and 20 of the composite bar 12 is specially shaped with two angled surfaces 28 and 30, the first surface 28 being flat and approximately perpendicular to a longitudinal axis 38 of the rod 12 and the second surface 30 being inwardly beveled at approximately 45 degrees from the longitudinal axis 38 of the rod 12. The unique shape of the two angled surfaces 28 and 30 on the ends 16 and 20 of the composite bar 12 and corresponding mating angled surfaces 28' and 30' provided on both the proximal end 32 of the first metal end fitting 14 and on a proximal end 53 of the male threaded half 22 of the second metal end fitting 18 facilitate even distribution of mechanical stress between the metal end fittings 16 and 20 and the composite bar 12, thus preventing the composite bar 12 from being damaged at its ends 16 and 20 when the push rod 10 is placed under stress.

Interior to the mating surfaces 28' and 30' on each of the metal end fittings 14 and 18 is provided a hollow tube 43 that inserts into the interior bore 40 of the bar 12 when the fittings 14 and 18 bond to the bar 12. The purpose of the tubes 43 is to stabilize the fittings 14 and 18 in their attachment to the bar 12, and thereby help to prevent damage to the bar 12.

Referring now also to FIGS. 6–9 for metal end fitting 14 and to FIGS. 10–17 for metal end fitting 18, the metal end fittings 14 and 18 bond via corresponding mating surfaces 28' and 30' provided on proximal ends, 32 and 34 respectively, of each of the metal end fittings 14 and 18. The metal end fittings 14 and 18 bond to the ends 16 and 20 of the composite bar 12 with epoxy or other suitable adhesive means.

The first angled surface 28 is provided between an exterior surface 36 of the composite bar 12 and the second angle surface 30, and the first angled surface 28 is approximately perpendicular to a longitudinal axis 38 of the composite bar 12. The second angled surface 30 is at an angle of approximately a 45 degrees to the longitudinal axis 38, as illustrated by the letter X in FIG. 4, and the second angled surface 30 is provided between the first angle surface 28 and an interior bore 40 provided within the composite bar 12.

Each of the metal end fittings 14 and 18 is provided with a rounded end 42 and 44, respectively. The rounded end 42 is provided on metal end fitting 14 on a distal end 46 of the fitting 14. The rounded end 44 is provided on metal end fitting 18 on a distal end 48 of the female threaded half 24 of the fitting 18.

As shown in FIG. 1, the second metal end fitting 18 adjusts in length 49 to allow the push rod 10 to be adjustable in its length 50. The second metal end fitting 18 is comprised of three pieces: the female threaded half 24, the male threaded half 22 having a distal end 51 with male threads 45 that threadably engages female threads 47 on a threaded proximal end 52 of the female threaded half 24, and the locking nut 26 that threadably travels along the male threaded half 22 and reversibly engages the female threaded half 24 to secure the female and male threaded halves 24 and 22 relative to each other after the length 49 of the second metal end fitting 18 and the associated length 50 of the push rod 10 have been adjusted.

To adjust the length 49 of the second metal end fitting 18 and thereby adjust the length 50 of the push rod 10, the locking nut 54 is first turned in a direction relative to the male threaded half 22 so that it disengages a proximal end 52 of the female threaded half 24 and thereby releases the female threaded half 24 to be turned relative to the male threaded half 22. Next, the female threaded half 24 is turned relative to the male threaded half 22 so as to lengthen or shorten the push rod 10, as needed to achieve the desired length 50 for the push rod 10. Both the proximal end 34 of the male threaded half 22 of the second metal end fitting 18 and the proximal end 52 of the female threaded half 24 of the second metal end fitting 18 are each provided externally with opposite flattened sides 57 so that the flattened sides 57 may be engaged by a wrench to turn the ends 14 and 18 relative to each other. When the push rod 10 is at the desired length 50, the locking nut 26 is then turned so that it again engages the proximal end 52 of the female threaded half 24.

In order to construct the composite push rod 10, the bar 12 is first constructed and then the metal end fittings 14 and 18 are bonded. As illustrated in FIG. 5, the bar 12 is constructed of a plurality of layers of sheets of epoxy impregnated, longitudinally oriented fiber material 53 that are wrapped around a removable mandrel (not illustrated). The sheets of longitudinally oriented fiber material 53 form the inner portion 54 of the push bar 12 and a single outside sheet of epoxy impregnated, woven fiber material 55 that is wrapped around the sheets of longitudinally oriented fiber material 53 forms the outside portion 56 of the bar 12. The sheets of fiber material 53 and 55 are comprised of one or more types of fibers, such as carbon, Kevlar, glass, etc. Also, the sheets of fiber material 53 and 55 are resin impregnated with a thermosetting, high temperature, toughened epoxy. Preferably, there will be approximately 5 to 50 layers of sheets of longitudinally oriented fiber material in the inner portion 54 of the composite bar 12. Once all of the layers of fiber material 53 and 55 are wrapped together, they are heated and compressed to thermo-set the layers 53 and 55 into a single composite bar 12. The mandrel (not illustrated) is then removed from the bar 12, leaving an interior bore 40 in the bar 12 where the mandrel was located. Each of the metal end fittings 14 and 18 is likewise provided with an interior bore 40' and 40" so that together the three bores 40, 40' and 40" form a continuous passageway that extends longitudinally through the push rod 10.

The ends 16 and 20 of the composite bar 12 are then cut, as previously described, to the proper shape. Finally, the mating surfaces 28' and 30' of metal end fitting 32 are bonded to the end surfaces 28 and 30 of the first end 16 of the composite bar 12 via epoxy and the mating surfaces 28' and 30' of metal end fitting 34 are bonded to the end surfaces 28 and 30 of the second end 20 of the composite bar 12 via epoxy, thereby completing construction of the composite push rod 10.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A composite push rod comprising:

a hollow composite bar, a first end fitting bonded to a first end of said composite bar, a second end fitting bonded to a second end of said composite bar, both said first and second end fittings provided with a rounded end, said second end fitting adjustable in length, an inner portion of said bar constructed of multiple layers of sheets of thermosetting, epoxy impregnated, longitudinally oriented fiber material, and an outer portion of said bar constructed of a single layer of a sheet of thermosetting, epoxy impregnated, woven fiber material.

2. A composite push rod according to claim 1 wherein the inner portion of the bar consists of between 5 and 50 layers of sheets of thermosetting, epoxy impregnated longitudinally oriented fiber material.

3. A composite push rod according to claim 2 wherein the first and second end fittings are each provided with a bore that extends through its corresponding fitting, and the bores that are provided in the fittings are continuous with an internal bore provided in the hollow bar so that there is a continuous bore through the bar and its bonded end fittings.

4. A composite push rod comprising:

a hollow composite bar, a first end fitting bonded to a first end of said composite bar, a second end fitting bonded to a second end of said composite bar, both said first and second end fittings provided with a rounded end, said second end fitting adjustable in length, the first and second ends of the composite bar each provided with a beveled surface, a mating beveled surface provided on each of the first and second end fittings, and said mating beveled surfaces provided on the end fittings where the fittings bond to an end of the composite bar.

5. A composite push rod according to claim 4 wherein the beveled surface provided on each of the first and second ends forms an angle of approximately 45 degrees with a longitudinal axis of the rod.

6. A composite push rod according to claim 4 further comprising:

a tube provided on each end fitting where the fitting bonds to an end of the composite bar so that the tube inserts into a bore provided in the bar when the end fitting is bonded to its corresponding end of the bar.

7. A Composite push rod according to claim 4 wherein the first and second end fittings are each provided with a bore that extend through the fitting and the bores are continuous with an internal bore provided in the hollow bar so that there is a continuous bore through the bar and its bonded end fittings.

8. A composite push rod according to claim 4 wherein said hollow composite bar further comprises:

an inner portion of said bar constructed of multiple layers of sheets of thermosetting, epoxy impregnated, longitudinally oriented fiber material, and an outer portion of said bar constructed of a single layer of a sheet of thermosetting, epoxy impregnated, woven fiber material.

9. A composite push rod according to claim 8 wherein the inner portion of the bar consists of between 5 and 50 layers of sheets of thermosetting, epoxy impregnated longitudinally oriented fiber material.

10. A composite push rod according to claim 4 further comprising:

the first and second ends of the composite bar each provided with a flat second surface that mates with a flat second mating surface provided on each of the first and second end fittings, said flat second mating surfaces provided on the end fittings where the fittings bond to an end of the composite bar.

11. A composite push rod according to claim 10 wherein the flat second surface provided on each of the first and second ends of the composite bar is approximately perpendicular to a longitudinal axis of the bar.

* * * * *